US007450869B2

(12) United States Patent
Geleynse et al.

(10) Patent No.: US 7,450,869 B2
(45) Date of Patent: Nov. 11, 2008

(54) TRANSFER COMPONENT MONITORING METHODS, IMAGE FORMING DEVICES, DATA SIGNALS, AND ARTICLES OF MANUFACTURE

(75) Inventors: Carl D. Geleynse, Eagle, ID (US); Michael Lloyd, Meridian, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 791 days.

(21) Appl. No.: 10/318,965

(22) Filed: Dec. 12, 2002

(65) Prior Publication Data

US 2004/0114947 A1 Jun. 17, 2004

(51) Int. Cl.
*G03G 15/14* (2006.01)

(52) U.S. Cl. ..... 399/31; 399/297

(58) Field of Classification Search ..... 399/31, 399/297

See application file for complete search history.

(56) References Cited

U.S. PATENT DOCUMENTS 6,363,228 B1 3/2002 Ream
6,549,733 B2 * 4/2003 Matsuguma ..... 399/26
6,633,732 B2 * 10/2003 Siegel et al. ..... 399/31

* cited by examiner

*Primary Examiner*—David M Gray
*Assistant Examiner*—Erika J. Villaluna

(57) ABSTRACT

Transfer component monitoring methods, image forming devices, data signals, and articles of manufacture are described. According to one aspect, a transfer component monitoring method includes counting a plurality of imaging operations performed by an image forming device to form a plurality of hard images and adjusting a result of the counting to determine wear of a transfer component of the image forming device, wherein the transfer component is configured to assist with a transfer of a developing material to form the hard images.

40 Claims, 4 Drawing Sheets

TRANSFER COMPONENT MONITORING METHODS, IMAGE FORMING DEVICES, DATA SIGNALS, AND ARTICLES OF MANUFACTURE

FIELD OF THE INVENTION

The invention relates to transfer component monitoring methods, image forming devices, data signals, and articles of manufacture.

BACKGROUND OF THE INVENTION

Image forming devices are utilized in an ever-increasing number of applications. An exemplary image forming device is an electro-photographic printer which may be utilized to form hard images. Initially, monochrome electro-photographic printers were introduced, and more recently, electro-photographic printers capable of color imaging have been utilized to provide enhanced imaging operations and capabilities.

Some electro-photographic printer configurations utilize a transfer assembly which may include a belt for receiving a toned image or carrying media which receives a toned image in the process of forming a hard image. For example, the toned image may be received from a photoconductive drum or from some other intermediate material. The toned image may be subsequently transferred to media, or the media having the toned image removed from the belt, to proceed in the imaging process.

The material of the transfer belt is subjected to wear and accordingly the belts are replaced periodically. In some arrangements, the replacement of the belt necessitates replacement of the transfer assembly. Accordingly, determining an end of life condition of a transfer belt or transfer assembly is desired if such components will not last the life of the product.

A mechanical counter may be utilized to count rotations of a transfer belt (similar to an odometer type of device) and to trip a sensor at a predetermined number of rotations of the belt. Utilization of the mechanical counter has associated disadvantages of additional cost of the counter and sensor, additional complexity, and additional components which may be subject to failure. Additionally, any differences between wear resulting from printing versus spinning up/down operations is not accounted for. Another method of determining the life span of a transfer assembly includes counting pages in a formatter. However, this method does not account for the affect of wear during rotations at the beginning and end of print jobs. For the maximum benefit to a consumer, the end of life of the transfer belt should be determined at a point just before print quality or reliability is compromised. The above-described exemplary methods require a designer to limit a life of the transfer belt to worst case conditions or risk an unexpected failure before end of life.

Accordingly, improved methods and apparatus for determining capacity of transfer components are desired.

DETAILED DESCRIPTION OF THE INVENTION

Figure 1:
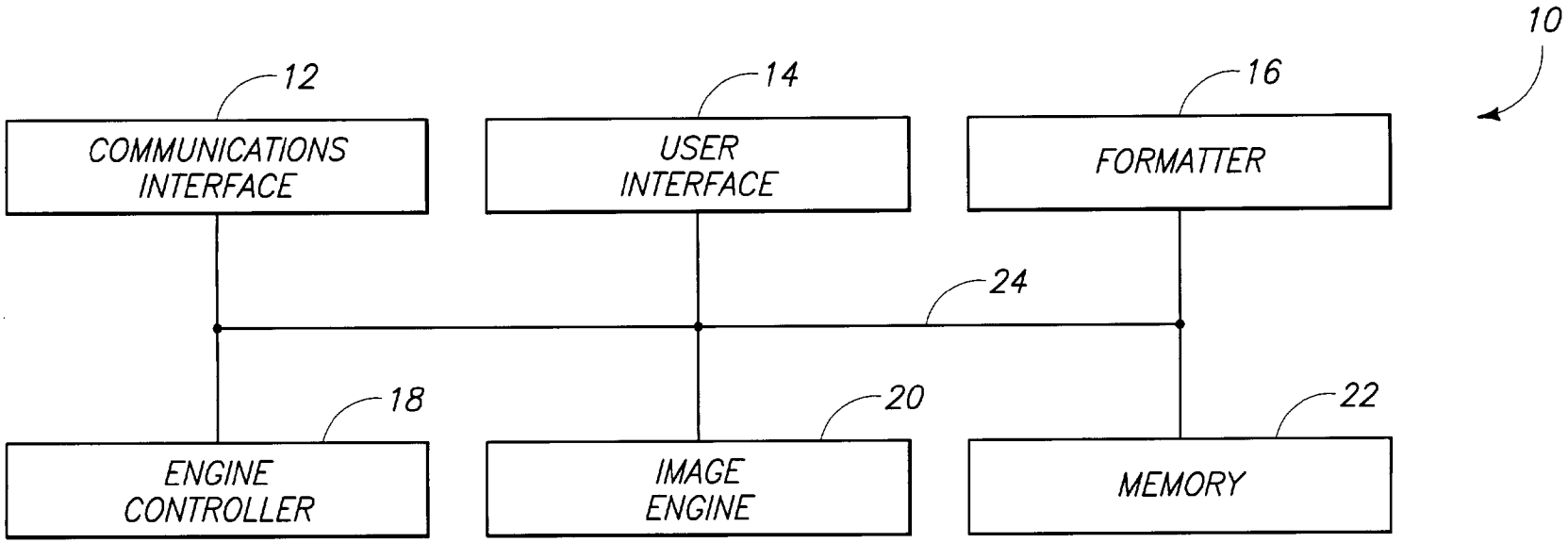
FIG. 1 is a functional block diagram of an exemplary image forming device according to one embodiment.

According to one aspect, a transfer component monitoring method includes counting a plurality of imaging operations performed by an image forming device to form a plurality of hard images and adjusting a result of the counting to determine wear of a transfer component of the image forming device, wherein the transfer component is configured to assist with a transfer of a developing material to form the hard images.

According to another aspect, a transfer component monitoring method comprises counting a number of jobs imaged using a transfer component of an image forming device, wherein the transfer component is configured to assist with a transfer of a developing material to form hard images of the jobs, counting a number of pages imaged using the transfer component of the image forming device, and determining a capacity of the transfer component using the number of jobs imaged and the number of pages imaged.

According to an additional aspect, an image forming device comprises an image engine configured to form hard images, wherein the image engine comprises a transfer component configured to assist with a transfer of a developing material to form the hard images and processing circuitry configured to count a plurality of imaging operations performed by the image forming device during the formation of the hard images, and to adjust a result of the counting to provide a capacity of the transfer component.

According to another additional aspect, an image forming device comprises means for performing a plurality of imaging operations for forming a plurality of hard images responsive to a number of image jobs, wherein the means for performing comprises a transfer component configured to assist with a transfer of a developing material to form the hard images, means for counting at least some of the imaging operations, and means for adjusting a result of the counted imaging operations to determine wear of the transfer component.

According to yet another aspect, a data signal embodied in a transmission medium comprises processor-usable code configured to cause processing circuitry to count a plurality of imaging operations performed by an image forming device to form a plurality of hard images using a transfer component, wherein the transfer component is configured to assist with a transfer of developing material to form the hard images and processor-usable code configured to cause processing circuitry to adjust a result of the counting to determine wear of the transfer component.

According to still yet another aspect, an article of manufacture comprises a processor-usable medium having processor-useable code embodied therein and configured to cause processing circuitry to count a plurality of imaging operations performed by an image forming device to form a plurality of hard images using a transfer component, wherein the transfer component is configured to assist with a transfer of developing material to form the hard images, and adjust a result of the counting to determine wear of the transfer component.

FIG. 1 depicts components of an exemplary image forming device 10. Image forming device 10 is arranged to generate hard images upon media such as paper, labels, transparencies, roll media, etc. Hard images include images physically rendered upon physical media. Exemplary image forming devices 10 include printers (e.g., monochrome or color laser printers), facsimile devices, copiers, multiple-function products (MFPs), or other devices capable of forming hard images upon media.

The exemplary configuration of image forming device 10 of FIG. 1 includes a communications interface 12, a user interface 14, a formatter 16, an engine controller 18, an image engine 20, and a memory 22. A bus 24 is depicted to provide bidirectional communications between one or more of the components. The depicted components and configuration of image forming device 10 is exemplary and other arrangements of device 10 configured to form hard images are possible. Exemplary embodiments herein will be discussed with reference to a color laser printer configuration although aspects of the present invention apply to other image forming device configurations capable of forming hard images.

Communications interface 12 is arranged to couple with an external network medium (not shown) to implement input/output communications between image forming device 10 and external devices, such as one or more host device (not shown). Communications interface 12 may be implemented in any appropriate configuration depending upon the application of image forming device 10. For example, communications interface 12 may be embodied as a network interface card (NIC) in one embodiment.

User interface 14 is arranged to depict status information regarding operations of image forming device 10. In one embodiment, user interface 14 is embodied as a liquid crystal display (LCD) although other configurations are possible. User interface 14 may also include a keypad or other input device for receiving user commands or other user input.

Formatter 16 is arranged to process image jobs to implement imaging of the jobs. For example, image data of image jobs in device 10 may include page description language (PDL) data, such as printer command language (PCL) data or Postscript data. Formatter 16 operates to rasterize the image data to provide bit map representations of the image data for imaging using image engine 20. Formatter 16 presents rasterized data to a transfer assembly (FIG. 2) of image engine 20 for imaging. Image data may refer to any data desired to be imaged and may include application data (e.g., in a driverless printer environment), PDL data, rasterized data or other data.

Formatter 16 may include processing circuitry to perform and/or control exemplary operations of device 10 including transfer component wear monitoring and wear calculation operations. The processing circuitry may execute executable instructions stored within articles of manufacture, such as memory 22, mass storage devices (e.g., hard disk drives, floppy disks, optical disks, etc.) or within another appropriate device, and embodied as, for example, software and/or firmware instructions.

Engine controller 18 is arranged to communicate with formatter 16 and engine controller 18 may receive status information regarding image jobs such that engine controller 18 may properly control paper path motors, implement electrical charging of transfer or fuser components and perform other operations to implement imaging of processed jobs. Engine controller 18 may include processing circuitry, such as a microprocessor, arranged to control operations of image engine 20. Engine controller 18 may communicate with paper handling assemblies (not shown), power supplies (not shown) and other appropriate components for implementing imaging operations. Accordingly, processing circuitry is provided in both the formatter 16 and engine controller 18 in the described exemplary configuration. Other configurations are possible (e.g., provision of processing circuitry within a single microprocessor).

Image engine 20 uses consumables to implement the formation of hard images. Exemplary consumables include media and developing material (e.g., toner). In one exemplary embodiment, image engine 20 is arranged as a print engine and includes an imaging assembly (FIG. 2), a transfer assembly (FIG. 2) and a fusing assembly (not shown) to develop hard images using the developing material and to affix the developing material to the media to render hard images upon the media. Other constructions or embodiments of image engine 20 are possible including configurations for forming hard images within copy machines, facsimile machines, multifunctional peripherals (MFPs), all-in-one devices, etc.

Memory 22 stores digital data and instructions executable by processing circuitry of formatter 16 or other processing circuitry of image forming device 10 (e.g., processing circuitry of engine controller 18). Exemplary memory 22 is implemented as random access memory (RAM), read only memory (ROM), and/or flash memory in exemplary configurations. Memory 22 may be arranged to store image data, executable code and other appropriate digital data to be stored within image forming device 10. Additionally, memory 22 may include a mass storage device, such as a hard disk drive, or other appropriate storage device configurations.

Figure 2:
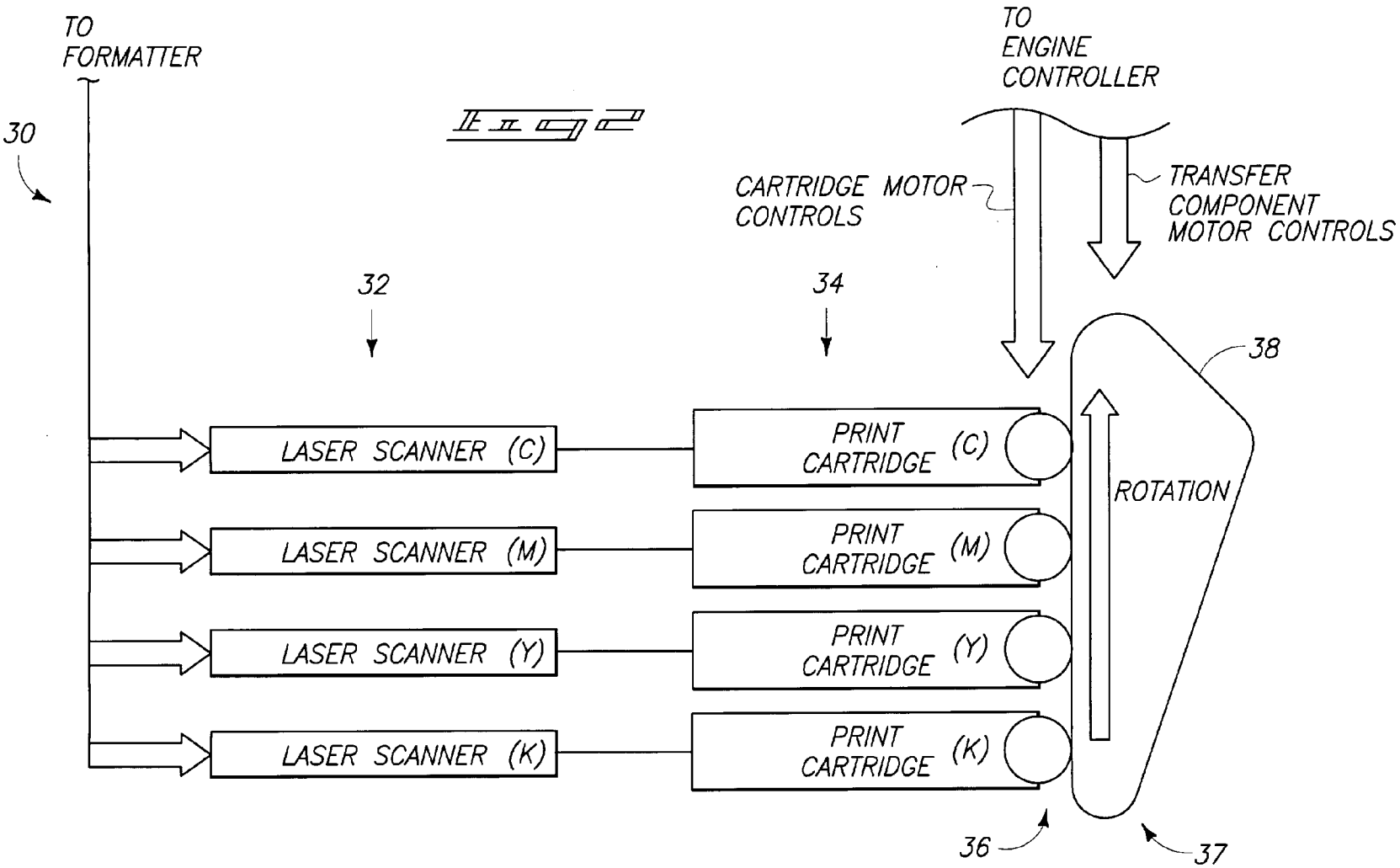
FIG. 2 is an illustrative representation of components of an exemplary transfer assembly according to one embodiment.

Referring to FIG. 2, an exemplary imaging assembly 30 and a transfer assembly 37 of image engine 20 are illustrated. The depicted exemplary imaging assembly 30 includes a plurality of laser scanners 32, a plurality of print cartridges 34, and a plurality of photoconductive drums 36 (which may be included in respective print cartridges 34). The illustrated exemplary transfer assembly 37 includes a transfer component 38.

In accordance with the exemplary described embodiment, the depicted imaging assembly 30 and transfer assembly 37 are arranged to implement image formation and transfer operations for a color laser printer as mentioned above. In particular, in the depicted exemplary assembly 30, laser scanners 32, print cartridges 34 and drums 36 are configured to implement CMYK imaging operations of the developing material, and component 38 provides transfer of developing material in the respective colors of cyan, magenta, yellow and black to form color hard images. Other imaging and transfer assembly configurations are possible corresponding to the associated configuration of the image forming device 10 and may render monochrome images or color images according to other formats, such as CMY.

Laser scanners 32 are coupled with formatter 16 and are arranged to control the generation of toned images for the respective colors responsive to rasterized data generated by formatter 16. Print cartridges 34 and drums 36 are operable to provide toned images for the respective colors responsive to scanned images from laser scanners 32. In addition, engine controller 18 is operable to control motors (not shown) of print cartridges 34 and control motors (not shown) which move transfer component 38.

Transfer component 38 is arranged to assist with a transfer of the developing material to form hard images. For example, in a first configuration, media (not shown) is transported using the transfer component 38 adjacent to drums 36 to directly receive toned images from drums 36. In another arrangement, transfer component 38 may receive toned images from respective drums 36 and subsequently transfer the toned images to media in conjunction with a transfer roller (not shown). In the depicted exemplary embodiment, transfer component 38 is implemented as a transfer belt. Other configurations of transfer component 38 are possible.

During usage, transfer component 38 is subjected to wear. The number of images that can be formed using transfer component 38 is a function of the total wear of the belt. The wear is influenced by a plurality of elements or factors also referred to as imaging operations. For example, wear is influenced by the number of pages printed using the transfer component 38, the number of spin-up/down rotations, the size of the page, the number and type of calibration operations performed (e.g., maximum density, half tone, color plane registration), and the number of cleaning operations performed.

According to some aspects of the invention, wear of transfer component 38 may be determined by counting imaging operations of device 10 and adjusting results of the counting according to respective wear factors. In one example, the counted number of operations may be multiplied by respective factors, summed with one another, and compared to a total wear capacity of transfer component 38. For example, equation 1 provides one exemplary calculation to determine wear and/or capacity of transfer component 38:

$$(\#\text{pages})*F1+(\#\text{spin-up/down rotations})*F2+(\#\text{cleaning rotations})*F3+(\#\text{calibration rotations})*F4=\text{total wear capacity} \quad \text{Equation 1}$$

In equation 1, the number of pages imaged using device 10 may be multiplied by a first wear factor F1. The number of rotations of transfer component 38 due to spin-up/down operations may be multiplied by a second wear factor F2. The number of cleaning rotations of transfer component 38 may be multiplied by a third wear factor F3 and the number of calibration rotations of transfer component 38 may be multiplied by a fourth factor. The resultant calculations may be summed and compared to a total wear capacity of transfer component 38 to indicate life or capacity of transfer component 38.

In the described exemplary configuration, formatter 16 counts the respective imaging operations and adjusts the counted number of imaging operations using appropriate wear factors (e.g., stored within memory 22). Equation 1 may be used to compare the calculated total wear (counted, adjusted and summed imaging operations) to the total wear capacity of the respective transfer component 38 to provide a remaining capacity of transfer component 38 to perform imaging operations and/or to provide a consumed capacity of transfer component 38 consumed by the imaging operations to date. The factors F1-F4 and total wear capacity are determined corresponding to the particular construction of the transfer component 38 being utilized and may be empirically derived.

Accordingly, in one embodiment, a number of imaging operations performed by image forming device 10 to form hard images are counted. The results of the counted number of imaging operations may be adjusted to determine wear of transfer component 38 and to determine a capacity of the transfer component 38. As indicated above, exemplary counting of imaging operations include counting a number of imaging operations relative to the transfer component 38, such as pages printed using component 38, spin-up/down rotations, calibration, cleaning, etc.

In another arrangement, some of the imaging operations of device 10 may be approximated and not directly counted to determine remaining and/or consumed capacity of transfer component 38. For example, formatter 16 may readily directly access information regarding the number of pages printed and the number of jobs imaged but may not have access to information regarding calibration operations, cleaning operations and spin-up/down rotations. Additional aspects of the invention enable determination or estimation of wear of transfer component 38 without directly counting some of the imaging operations associated with or responsible for wear of transfer component 38.

Causes or elements of wear identified above may be directly or roughly proportional to the number of pages imaged or the number of jobs sent to image engine 20. The number of pages imaged may be provided or counted directly by formatter 16. In general, spin-up/down rotations are proportional to the number of job sent. However, with complex jobs of multiple pages, formatter 16 may not be able to maintain processing speeds on par with imaging of pages using image engine 20 (e.g., due to complex rasterization processing). Accordingly, components of image engine 20 may spin down and back up without formatter 16 counting a job boundary. Also, if multiple jobs are sent to image engine 20 at a moment in time, components of image engine 20 may not spin down and back up between jobs. In one aspect, these two events are assumed to be opposite in effect on calculated wear of transfer component 38 and may reduce the error induced by each alone. In one embodiment, a wear factor utilized to adjust the counted number of jobs imaged may be configured to accommodate spin-up/down operations without actually counting such operations or wear from such operations may be negligible due to the above-described cancellation.

Calibration operations may be performed at regular page count intervals. In addition, calibrations may be performed at power-up operations, cartridge changes, and coming out of sleep mode operations. Cartridge changes are generally proportional to page count depending on coverage while power-up events are not necessarily proportional to either pages or jobs. Calibration operations may be accommodated or estimated within the wear factor for adjusting the number of page count and a total wear estimation for a given belt (e.g., see equation 2 below).

Cleaning operations are typically performed at the end of calibration operations, following paper jams and when closing cover doors or access doors (not shown) of device 10. Paper jams may be considered roughly proportional to page count and can be accounted for in a wear factor to adjust a determined page count or assumed to be negligible for reliable printers.

Equation 2 provides transfer component life monitoring by counting some imaging operations to monitor wear and estimating or determining wear resulting from other imaging operations without actually counting the number of other imaging operations using the above assumptions regarding spin-up/down rotations, calibration operations, and cleaning operations.

$$\text{pagesRem}=(\text{max}-(\text{pageWear}*\text{pageCount}+\text{jobWear}*\text{numJobs}))*(\text{pageMax}/\text{max}) \quad \text{Equation 2}$$

wherein: max=Maximum component capacity in wear units jobWear=Component wear factor per job in wear units pageWear=Component wear factor per page in wear units pageMax=Maximum number of printed pages where the average job size equals the expected job size pageRem=Estimated number of pages remaining (remaining capacity)

numJobs=The number of jobs printed pageCount=The number of pages printed.

Utilization of equation 2 provides an advantage with respect to equation 1 of monitoring fewer imaging operations of device 10 while wear due to imaging operations which are not monitored or are independent of monitored imaging operations is estimated.

Exemplary values for use in equation 2 may include max 200,000 wear units, jobWear=2 wear units, pageWear=1 wear unit and pageMax=120,000 pages when an average job size is three pages for transfer component 38 and utilized for example in a LaserJet® 4600 color printer available from Hewlett-Packard Company. The wear factors, wear units, and values of equation 2 may be associated with the respective individual transfer component 38 utilized. Other wear factors, wear units and values may be empirically derived using appropriate configurations of device 10 and component 38.

In the presently described aspect, transfer component 38 includes a predetermined number of wear units when transfer component 38 is in new condition. The wear units of transfer component 38 are reduced during the performing of imaging operations and can be utilized to represent a remaining capacity and/or consumed capacity of transfer component 38.

The average number of pages per job (or job length) is a factor which impacts a useful life of transfer component 38. The shorter the average job, the shorter the life of transfer component 38. The above-identified pageMax value is derived from assuming an average job length of three pages in length. The accuracy of the length of the typical user's job and the value of pageMax that corresponds to the job length provides the most accurate prediction of capacity of transfer component 38.

Figure 3:
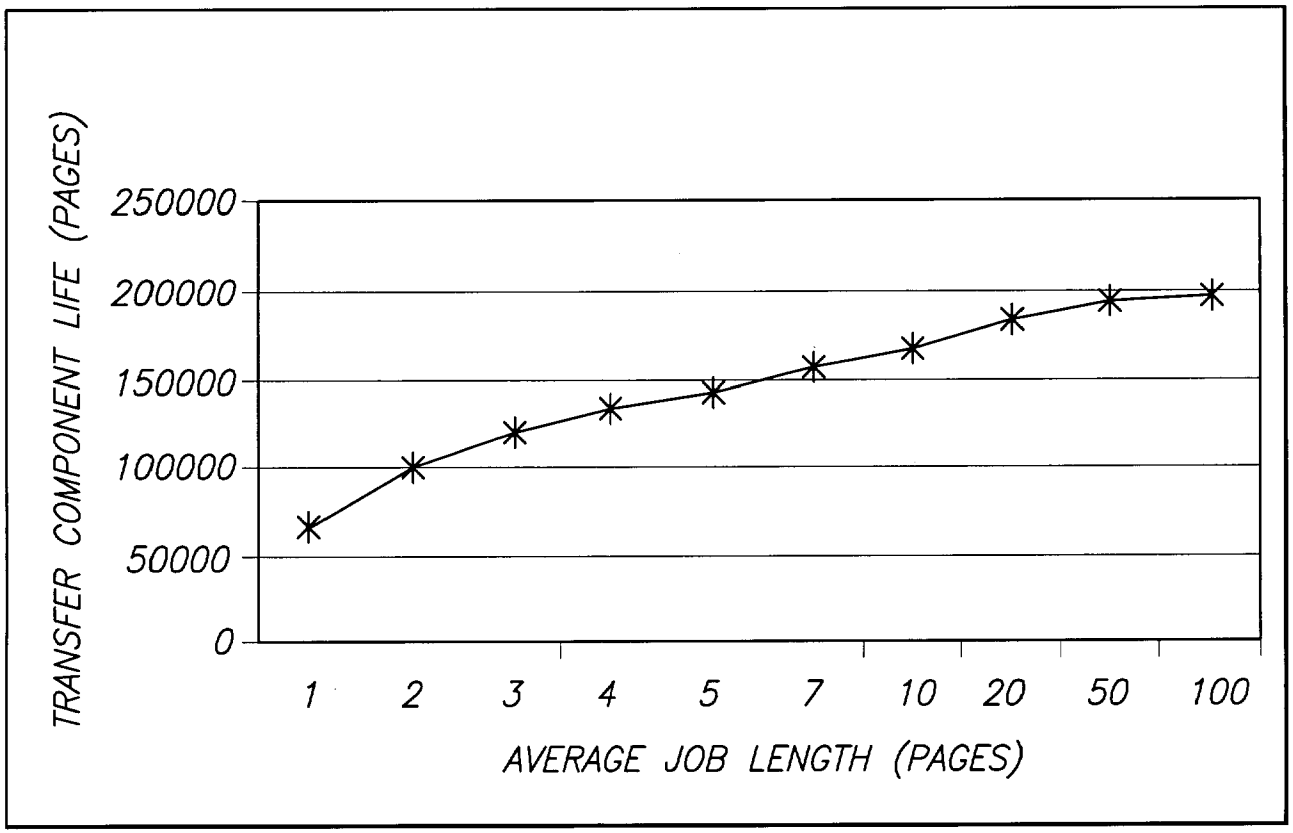
FIG. 3 is a graphical representation depicting exemplary transfer component life versus average image job length.

Referring to FIG. 3, a page count for a transfer component 38 is illustrated as a function of average job length. For users whose average job length is longer than three pages, the estimated pages remaining will decrement at a rate slower than the actual number of pages printed, but will be correct for remaining jobs of three pages average. For users whose average job length is less than three pages, the estimated pages remaining decrement at a rate faster than the actual number of pages printed, but will also be correct for remaining jobs of three pages. Accordingly, the exact factors and wear units utilized in the associated equations to calculate capacity of transfer component 38 will vary upon the application or usage environment of device 10, specific configuration of transfer component 38, etc.

Additional aspects described herein provide monitoring of the number of pages imaged in a duplex mode and a simplex mode to calculate a capacity of transfer component 38. For example, for equation 2, the term (pageWear*pageCount) is replaced by:

(simPageWear*simPageCount+
dupImageWear*dupImageCount)

where:

simPageWear=Component wear per simplex page in wear units simPageCount=Number of pages printed in simplex mode dupPageWear=Component wear per image printed in wear units dupPageCount=Number of images printed in duplex mode.

The simPageWear and the dupPageWear factors may comprise different wear factors to indicate wear of transfer component 38 at different rates for the respective simplex and duplex imaging operations. During typical imaging operations, additional wear of transfer component 38 results from duplex imaging operations. Accordingly, the dupPageWear factor may indicate increased wear compared with the simPageWear factor to indicate increased wear for duplex operations.

In accordance with additional aspects, a size of media imaged may be monitored and affect wear calculations. For example, the pageWear factor may be selected from a plurality of factor values corresponding to the size of the media being imaged (e.g., the factor may indicate twice as much wear for media of a first size (ledger size) compared with indicated wear for media of a second size (letter size)). Other wear factor values may be used for ledger, letter or other sized media.

Figure 4:
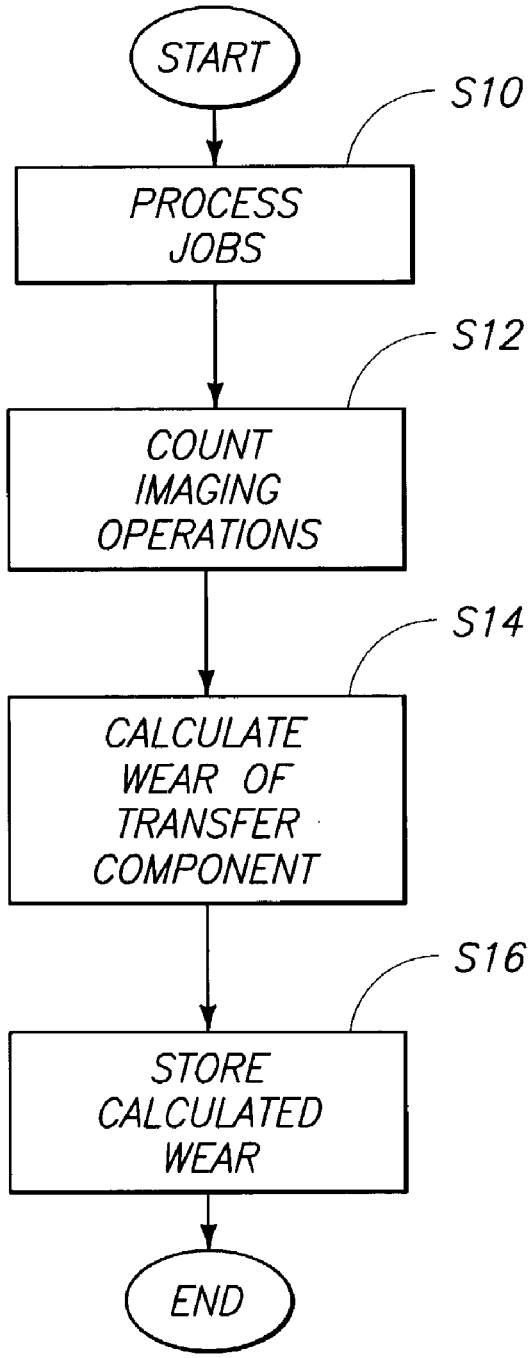
FIG. 4 is a flow chart of an exemplary methodology to determine a capacity of a transfer component according to one embodiment.

Referring to FIG. 4, an exemplary methodology to determine wear and/or capacity of transfer component 38 is illustrated. In one example, processing circuitry of formatter 16 is arranged to execute instructions stored within memory 22 to implement the depicted methodology. In other arrangements, processing circuitry of engine controller 18, other component, and/or external of device 10 may be utilized to perform the depicted exemplary methodology. In addition, other methods are possible including more, less or alternative steps.

At a step S10, the processing circuitry processes jobs and forwards processed image data to the transfer assembly for imaging.

At a step S12, the processing circuitry counts the number of respective imaging operations performed to form the hard images for the imaged jobs.

At step S14, the processing circuitry calculates wear and/or capacity of the transfer component. As described above, the wear and/or capacity may be calculated or determined responsive to the counted imaging operations and adjustment of the counted imaging operations utilizing appropriate wear factors described above.

At a step S16, the processing circuitry operates to store the calculated wear within an appropriate location such as the memory.

The determined wear and/or capacity may be utilized to generate indicators or alarms to a user (e.g., via user interface 14) indicating status of transfer component 38 or transfer assembly 37. In one arrangement, the indicators or alarms using the determined wear and/or capacity are configured to avoid possible downtime of image forming device 10 as a result of failure of transfer component 38 or transfer assembly 37.

At least some of the aspects of the invention may be implemented using appropriate processing circuitry configured to execute processor-usable or executable code stored within appropriate storage devices or communicated via a network or using other transmission media. For example, processor-usable code may be provided via articles of manufacture, such as an appropriate processor-usable medium comprising, for example, a floppy disk, hard disk, zip disk, optical disk, etc., or alternatively embodied within a transmission medium, such as a carrier wave and/or data packets, and communicated via a network, such as the Internet or a private network or other communication structure.

The protection sought is not to be limited to the disclosed embodiments, which are given by way of example only, but instead is to be limited only by the scope of the appended claims.

What is claimed is:

1. A transfer component monitoring method comprising:

rasterizing image data of image jobs for imaging by an image forming device to form a plurality of hard images;

counting a plurality of imaging operations performed by the image forming device to form the plurality of hard images, including determining a count of at least one of a number of pages imaged and a number of jobs imaged from the rasterizing of the image data of the image jobs;

adjusting a result of the counting of the imaging operations based on respective wear factors for each of the imaging operations to determine wear of a transfer component of the image forming device, wherein the transfer component is configured to assist with a transfer of a developing material to form the hard images;

determining a remaining capacity of the transfer component based on the adjusted result of the counting and the determined wear; and indicating to a user the remaining capacity of the transfer component.

2. The method of claim 1 wherein the counting comprises counting imaging operations using the transfer component.

3. The method of claim 1 wherein the counting comprises counting a number of pages imaged and a number of jobs imaged using the transfer component.

4. The method of claim 1 wherein the counting comprises counting a number of jobs imaged using the transfer component.

5. The method of claim 1 wherein the counting comprises counting a number of pages imaged using the transfer component.

6. The method of claim 1 wherein the counting comprises counting a number of respective pages imaged upon media of a plurality of different sizes, and wherein the adjusting comprises adjusting using a plurality of different wear factors corresponding to respective ones of the different sizes of media.

7. The method of claim 1 wherein the counting comprises counting a number of simplex pages imaged using the transfer component and counting a number of duplex pages imaged using the transfer component, and wherein the adjusting comprises adjusting the number of simplex pages and the number of duplex pages using different wear factors.

8. The method of claim 7 wherein the adjusting comprises adjusting the number of simplex pages according to a first wear factor and adjusting the number of duplex pages according to a second wear factor configured to indicate increased wear compared with the first wear factor.

9. The method of claim 1 wherein the counting comprises counting to determine wear of the transfer component resulting from the counted imaging operations, and the adjusting comprises adjusting to determine wear resulting from other imaging operations.

10. The method of claim 1 wherein the adjusting comprises adjusting to determine wear of the transfer component in addition to wear indicated from the counting.

11. The method of claim 1 wherein the adjusting comprises adjusting to determine wear of the transfer component from spin rotations.

12. The method of claim 1 wherein the adjusting comprises adjusting to determine wear of the transfer component from calibration operations.

13. The method of claim 1 wherein the adjusting comprises adjusting to determine wear of the transfer component from cleaning operations.

14. The method of claim 1 wherein the counting comprises counting only using a formatter of the image forming device and without information from an image engine of the image forming device.

15. A transfer component monitoring method comprising:

rasterizing image data of image jobs for imaging by an image forming device to form hard images of the jobs;

counting a number of jobs imaged using a transfer component of the image forming device, wherein the transfer component is configured to assist with a transfer of a developing material to form the hard images of the jobs;

counting a number of pages imaged using the transfer component of the image forming device;

determining wear of the transfer component of the image forming device and a remaining capacity of the transfer component using the number of jobs imaged and the number of pages imaged; and indicating to a user the remaining capacity of the transfer component, wherein at least one of the counting the number of jobs imaged and the counting the number of pages imaged is determined from the rasterizing of the image data of the image jobs.

16. The method of claim 15 wherein the countings individually comprise counting to determine wear of the transfer component related to respective ones of the number of jobs imaged and the number of pages imaged, and further comprising adjusting results of the countings to determine additional wear of the transfer component.

17. The method of claim 15 further comprising adjusting results of the countings to determine wear of the transfer component due to spin rotations, calibration operations and cleaning operations.

18. The method of claim 15 further comprising adjusting a result of the counting the number of jobs and a result of the counting the number of pages using different respective factors.

19. The method of claim 15 wherein the counting the number of pages comprises counting a number of simplex pages imaged using the transfer component and counting a number of duplex pages imaged using the transfer component, and further comprising adjusting the number of simplex pages and the number of duplex pages by different respective factors.

20. The method of claim 15 wherein the image forming device comprises a printer.

21. An image forming device comprising:

a formatter configured to rasterize image data of image jobs;

an image engine configured to receive the rasterized image data from the formatter and form hard images for the image jobs, wherein the image engine comprises a transfer component configured to assist with a transfer of a developing material to form the hard images; and processing circuitry configured to count a plurality of imaging operations performed by the image forming device during the formation of the hard images, and to adjust a result of the counting to provide a capacity of the transfer component, wherein the formatter includes the processing circuitry, and wherein a count of at least one of a number of pages imaged and a number of jobs imaged is determined from the formatter rasterizing the image data of the image jobs.

22. The device of claim 21 wherein the processing circuitry is configured to count to determine wear of the transfer component resulting from the counted imaging operations and to adjust the result of the counting to determine additional wear of the transfer component.

23. The device of claim 21 wherein the processing circuitry is configured to adjust the result to determine wear of the transfer component resulting from other imaging operations independent of the counted imaging operations.

24. The device of claim 21 wherein the processing circuitry is configured to adjust the result to determine wear of the transfer component due to spin rotations, calibration operations and cleaning operations.

25. The device of claim 21 wherein the processing circuitry is configured to count a number of jobs and pages imaged using the transfer component to count the imaging operations.

26. The device of claim 21 wherein the processing circuitry is configured to count a number of simplex pages imaged using the transfer component and to count a number of duplex pages imaged using the transfer component, and wherein the processing circuitry is configured to adjust the number of simplex pages and the number of duplex pages using different wear factors.

27. The device of claim 26 wherein the processing circuitry is configured to adjust the number of simplex pages according to a first wear factor and to adjust the number of duplex pages according to a second wear factor configured to indicate increased wear compared with the first wear factor.

28. The device of claim 21 wherein the image engine comprises a print engine of the image forming device comprising a printer.

29. An image forming device comprising:

means for rasterizing image data of a number of image jobs for forming a plurality of hard images for the image jobs;

means for performing a plurality of imaging operations for forming the plurality of hard images for the image jobs, wherein the means for performing comprises a transfer component configured to assist with a transfer of a developing material to form the hard images;

means for counting at least some of the imaging operations, wherein the means for counting determines a count of at least one of a number of pages imaged and a number of jobs imaged from the means for rasterizing the image data of the image jobs; and means for adjusting a result of the counted imaging operations to determine wear of the transfer component.

30. The device of claim 29 further comprising means for indicating a capacity of the transfer component using the adjusted result of the counted imaging operations.

31. The device of claim 29 wherein the means for counting comprises means for determining wear of the transfer component resulting from the counted imaging operations, and the means for adjusting comprises means for determining additional wear of the transfer component resulting from other imaging operations.

32. The device of claim 31 wherein the other imaging operations are independent of the some imaging operations.

33. The device of claim 29 wherein the means for counting comprises means for counting a number of imaging operations regarding the transfer of the developing material.

34. The device of claim 29 wherein the means for counting comprises means for counting a number of jobs imaged and a number of pages imaged using the transfer component.

35. The device of claim 29 wherein the means for counting comprises means for counting a number of simplex pages imaged using the transfer component and for counting a number of duplex pages imaged using the transfer component, and wherein the means for approximating comprises means for adjusting the number of the simplex pages and the number of the duplex pages by different factors.

36. An article of manufacture comprising:

a processor-usable medium having processor-useable code embodied therein and configured to cause processing circuitry to:

rasterize image data of image jobs for imaging by an image forming device to form a plurality of hard images;

count a plurality of imaging operations performed by the image forming device to form the plurality of hard images using a transfer component, wherein the transfer component is configured to assist with a transfer of developing material to form the hard images; and adjust a result of the counting to determine wear of the transfer component, wherein a count of at least one of a number of pages imaged and a number of jobs imaged is determined from the rasterizing of the image data of the image jobs.

37. The article according to claim 36 wherein the processor-usable code is configured to cause processing circuitry to count the imaging operations including a number of pages imaged and a number of jobs imaged using the transfer component.

38. The article according to claim 36 wherein the processor-usable code is configured to cause processing circuitry to count to determine wear of the transfer component resulting from the counted imaging operations, and to adjust to determine wear resulting from other imaging operations.

39. The article according to claim 36 wherein the processor-usable code is configured to cause processing circuitry to adjust to determine wear of the transfer component in addition to wear determined from the counting.

40. The article according to claim 36 wherein the processor-usable code is configured to cause processing circuitry to provide a capacity of the transfer component using the determined wear.

* * * * *